US011383531B2

(12) United States Patent
Miyazawa

(10) Patent No.: US 11,383,531 B2
(45) Date of Patent: Jul. 12, 2022

(54) INKJET PRINTER HAVING ULTRAVIOLET IRRADIATOR

(71) Applicant: MIMAKI ENGINEERING CO., LTD., Nagano (JP)

(72) Inventor: Daiki Miyazawa, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 17/170,806

(22) Filed: Feb. 8, 2021

(65) Prior Publication Data

US 2021/0252881 A1 Aug. 19, 2021

(30) Foreign Application Priority Data

Feb. 17, 2020 (JP) ..... JP2020-024737

(51) Int. Cl.
*B41J 11/00* (2006.01)
*B41J 2/01* (2006.01)

(52) U.S. Cl.
CPC .... *B41J 11/00212* (2021.01); *B41J 11/00214* (2021.01); *B41J 2/01* (2013.01)

(58) Field of Classification Search
CPC .. B41J 11/00212; B41J 11/00214; B41J 2/01; B41J 11/00218; B41J 25/308; B41J 11/002; B41J 25/3082; B41J 29/393
See application file for complete search history.

(56) References Cited

U.S. PATENT DOCUMENTS

2014/0354743 A1* 12/2014 Tsuchiya ..... B41J 11/0021 347/102

FOREIGN PATENT DOCUMENTS

JP 2004284141 10/2004

* cited by examiner

*Primary Examiner* — Bradley W Thies
(74) *Attorney, Agent, or Firm* — JCIPRNET

(57) ABSTRACT

An inkjet printer includes: an inkjet head configured to eject an ink of an ultraviolet-curable type to a medium; an ultraviolet irradiator arranged to adjoin the inkjet head in a main scanning direction where the inkjet head relatively moves with respect to the medium, the ultraviolet irradiator configured to irradiate the ink with an ultraviolet ray; and a controller configured to control the ultraviolet irradiator. In the inkjet printer, the ultraviolet irradiator includes an inner illumination region arranged near the inkjet head in the main scanning direction, and an outer illumination region arranged opposite the inkjet head across the inner illumination region in the main scanning direction, and the controller includes a first irradiation mode where the inner illumination region is unlit and the outer illumination region is lit, and a second irradiation mode where the inner illumination region is lit and the outer illumination region is lit.

16 Claims, 4 Drawing Sheets

INKJET PRINTER HAVING ULTRAVIOLET IRRADIATOR

CROSS REFERENCE TO RELATED APPLICATIONS

This application claims the priority benefit of Japanese Patent Application No. 2020-024737, filed on Feb. 17, 2020. The entirety of the above-mentioned patent application is hereby incorporated by reference herein and made a part of this specification.

TECHNICAL FIELD

The present disclosure relates to an inkjet printer configured to eject an ink of an ultraviolet-curable type.

DESCRIPTION OF THE BACKGROUND ART

Conventionally, as an inkjet printer, there is known an inkjet recording apparatus that includes an inkjet head and an ultraviolet irradiator. Here, the inkjet head ejects an ink of an ultraviolet-curable type, and the ultraviolet irradiator irradiates the ink with ultraviolet rays (see, for example, Japanese Unexamined Patent Publication No. 2004-284141, i.e., Patent Literature 1). In the inkjet recording apparatus, the ultraviolet irradiator and the inkjet head are arranged to adjoin each other at a predetermined interval such that the inkjet head is less prone to be clogged with the ink.

Patent Literature 1: Japanese Unexamined Patent Publication No. 2004-284141

In an inkjet printer, a head gap as a gap between an inkjet head and a recording medium is adjusted. The head gap is adjusted in accordance with, for example, surface roughness of the recording medium; and as the recording medium has greater surface roughness, the head gap is increased. Here, as the head gap is increased, the inkjet head is arranged farther from the recording medium. In this case, part of the ultraviolet rays irradiated by the ultraviolet irradiator is reflected on the recording medium to irradiate the inkjet head, in other words, typically called stray light is generated. Accordingly, as the head gap is increased, the stray light increases, and the inkjet head is thereby prone to be clogged with ink.

SUMMARY

In view of the respects described above, the present disclosure provides an inkjet printer capable of reducing ink clogging caused by stray light.

The present disclosure provides an inkjet printer including: an inkjet head configured to eject an ink of an ultraviolet-curable type to a recording medium; an ultraviolet irradiator arranged to adjoin the inkjet head in a main scanning direction where the inkjet head relatively moves with respect to the recording medium, the ultraviolet irradiator configured to irradiate the ink with an ultraviolet ray; and a controller configured to control the ultraviolet irradiator. In the inkjet printer, the ultraviolet irradiator includes an inner illumination region arranged near the inkjet head in the main scanning direction, and an outer illumination region arranged opposite the inkjet head across the inner illumination region in the main scanning direction, and the controller includes a first irradiation mode where the inner illumination region is unlit and the outer illumination region is lit, and a second irradiation mode where the inner illumination region is lit and the outer illumination region is lit.

With this configuration, when stray light is generated, the first irradiation mode is selected such that the inner illumination region of the ultraviolet irradiator is unlit. In other words, an illumination region near the inkjet head is unlit such that the inkjet head is less prone to be irradiated with the ultraviolet ray. With this configuration, the stray light directed to the inkjet head is reduced, and the inkjet head is less prone to be clogged with the ink due to the stray light. Note that, when the inkjet head is not clogged with the ink due to the stray light, the second irradiation mode is selected such that the ink is cured quickly.

The present disclosure provides an inkjet printer including: an inkjet head configured to eject an ink of an ultraviolet-curable type to a recording medium; an ultraviolet irradiator arranged to adjoin the inkjet head in a main scanning direction where the inkjet head relatively moves with respect to the recording medium, the ultraviolet irradiator configured to irradiate the ink with an ultraviolet ray; and a controller configured to control the ultraviolet irradiator. In the inkjet printer, the ultraviolet irradiator includes an inner illumination region arranged near the inkjet head in the main scanning direction, and an outer illumination region arranged opposite the inkjet head across the inner illumination region in the main scanning direction, and the controller includes a third irradiation mode where the inner illumination region is lit, having a radiation intensity smaller than a radiation intensity of the outer illumination region that is lit, and a fourth irradiation mode where the inner illumination region is lit, having the radiation intensity equal to the radiation intensity of the outer illumination region that is lit.

With this configuration, when stray light is generated, the third irradiation mode is selected such that the inner illumination region of the ultraviolet irradiator has the radiation intensity reduced. In other words, an illumination region near the inkjet head has the radiation intensity reduced, so that the inkjet head is less prone to be irradiated with the ultraviolet ray. With this configuration, the stray light directed to the inkjet head is reduced, and the inkjet head is less prone to be clogged with the ink due to the stray light. Note that, when the inkjet head is not clogged with the ink due to the stray light, the fourth irradiation mode is selected such that the ink is cured quickly.

The controller preferably includes a gap controller configured to adjust a head gap as a gap between the recording medium and the inkjet head, the controller preferably executes the first irradiation mode or the third irradiation mode when the head gap is equal to or greater than a threshold value, and the controller preferably executes the second irradiation mode or the fourth irradiation mode when the head gap is smaller than the threshold value.

With this configuration, when the head gap is equal to or greater than the threshold value, the stray light increases in an amount corresponding to a difference between the head gap and the threshold value. Accordingly, the first irradiation mode or the third irradiation mode is selected such that the stray light directed to the inkjet head is reduced. On the other hand, when the head gap is smaller than the threshold value, the stray light is less prone to be generated. Accordingly, the second irradiation mode or the fourth irradiation mode is selected such that the ink is cured quickly. Note that, the threshold value corresponds to a value of whether or not the inkjet head is clogged with the ink due to stray light.

The recording medium is preferably prepared in a plurality of types, each having different reflectance from the others. The controller preferably executes the first irradiation mode or the third irradiation mode when the reflectance of the recording medium is equal to or greater than a threshold value, and the controller preferably executes the second irradiation mode or the fourth irradiation mode when the reflectance of the recording medium is smaller than the threshold value.

With this configuration, when the reflectance of the recording medium is equal to or greater than the threshold value, the stray light increases in an amount corresponding to a difference between the reflectance and the threshold value. Accordingly, the first irradiation mode or the third irradiation mode is selected such that the stray light directed to the inkjet head is reduced. On the other hand, when the reflectance of the recording medium is smaller than the threshold value, the stray light is less prone to be generated. Accordingly, the second irradiation mode or the fourth irradiation mode is selected such that the ink is cured quickly. Note that, in this case too, the threshold value corresponds to the value of whether or not the inkjet head is clogged with the ink due to the stray light.

The controller preferably includes a speed controller configured to adjust scanning speed of the inkjet head, the controller preferably executes the first irradiation mode or the third irradiation mode when the scanning speed of the inkjet head is equal to or smaller than a threshold value, and the controller preferably executes the second irradiation mode or the fourth irradiation mode when the scanning speed of the inkjet head is greater than the threshold value.

With this configuration, when the scanning speed of the inkjet head is equal to or smaller than the threshold value, the stray light increases in an amount corresponding to an increase in cumulative light quantity. Accordingly, the first irradiation mode or the third irradiation mode is selected such that the stray light directed to the inkjet head is reduced. On the other hand, when the scanning speed of the inkjet head is greater than the threshold value, the stray light is less prone to be generated. Accordingly, the second irradiation mode or the fourth irradiation mode is selected such that the ink is cured quickly. Note that, in this case too, the threshold value corresponds to the value of whether or not the inkjet head is clogged with the ink due to the stray light.

Further, the ultraviolet irradiators, the number of which is two, are preferably arranged at both sides in the main scanning direction across the inkjet head. The ultraviolet irradiators preferably have an identical structure to each other, and within a plane including the main scanning direction and a sub scanning direction orthogonal to the main scanning direction, the ultraviolet irradiators are arranged point-symmetrically to each other at a symmetric point as a center, having phases of the ultraviolet irradiators different from each other by an amount equal to 180 degrees.

With this configuration, the ultraviolet irradiators, the number of which is two, are arranged point-symmetrically to each other, so that the ultraviolet irradiators have the identical structure. Accordingly, an increase in cost of apparatus is reduced.

DESCRIPTION OF EMBODIMENTS

An embodiment of the present disclosure will be described below with reference to the appended drawings. It should be noted that the present disclosure is not limited to the embodiment. Additionally, constituent elements described in the embodiment may be readily replaced by those skilled in the art within the scope of the appended claims; and any components that are substantially the same as the constituent elements in the embodiment are also encompassed within an aspect of the present disclosure. Further, the constituent elements described below may be combined appropriately as long as no conflict arises. When the present disclosure includes several embodiments, different embodiments may be combined with each other.

First Embodiment

An inkjet printer 1 (hereinafter, also simply referred to as a printer 1) according to a first embodiment is an apparatus for using an inkjet method to print an image on a medium 2 as a recording medium. The medium 2 may be, for example, a non-permeable medium using a metal, a resin, or the like that is non-permeable to an ink, or a permeable medium using a fabric, paper, or the like that is permeable to the ink. As long as the medium 2 is capable of printing the image, any one of the non-permeable medium and the permeable medium is applicable. With the medium 2 of this kind, reflectance of a surface to be printed, i.e., a surface to which the ink is ejected, varies in accordance with a type of the medium 2. The medium 2 is conveyed in a roll-to-roll method and is fed from a feed roller to be subjected to printing. When the printing on the medium 2 has completed, the medium 2 is wound by a winding roller. The ink is, for example, an ultraviolet-curable ink (UV ink) that is cured in ultraviolet rays. The UV ink has a high viscosity within a range of normal temperature (e.g., 15° C. to 25° C.).

Figure 1:
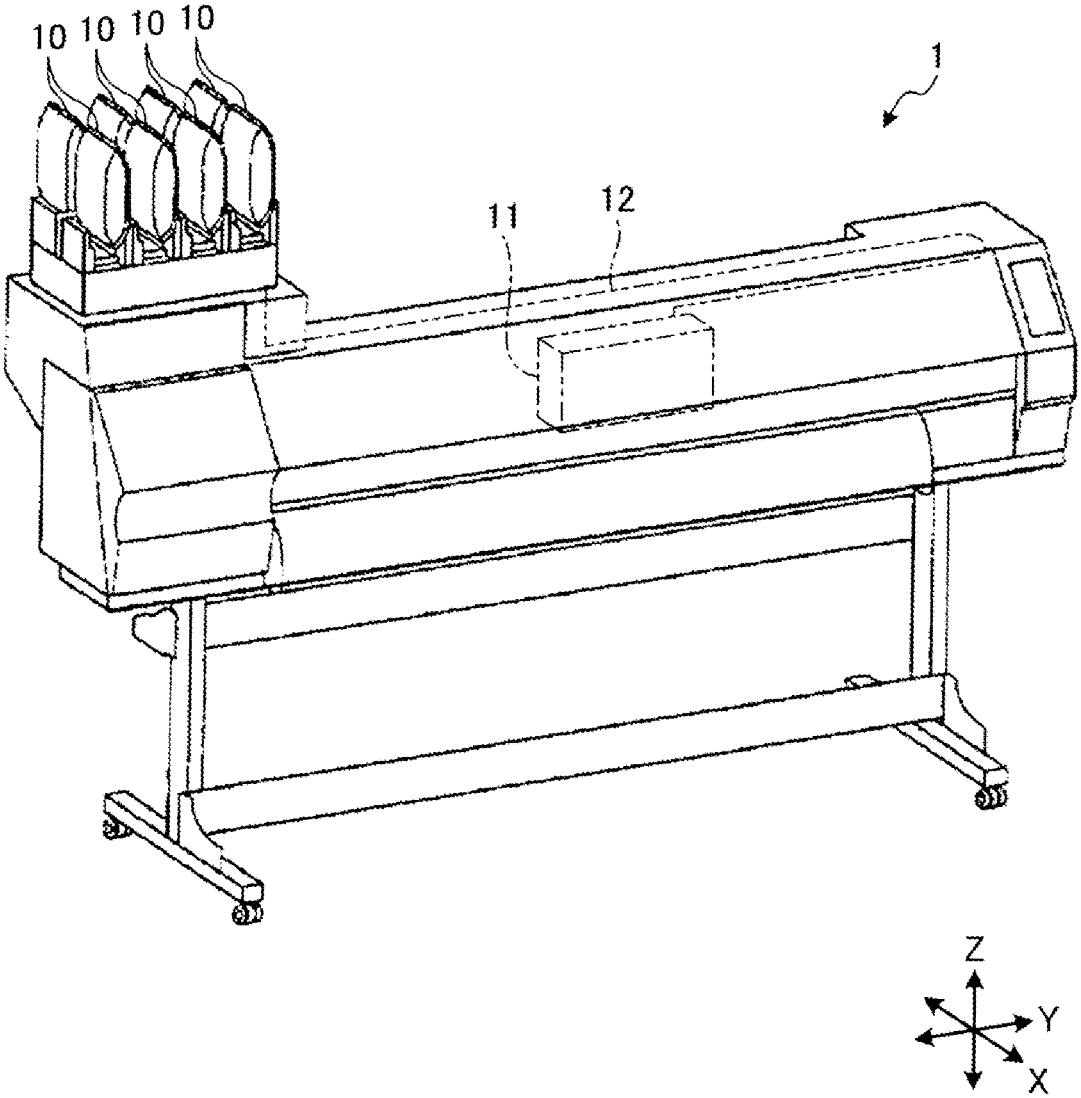
FIG. 1 is a perspective view of an inkjet printer according to a first embodiment.
Figure 2:
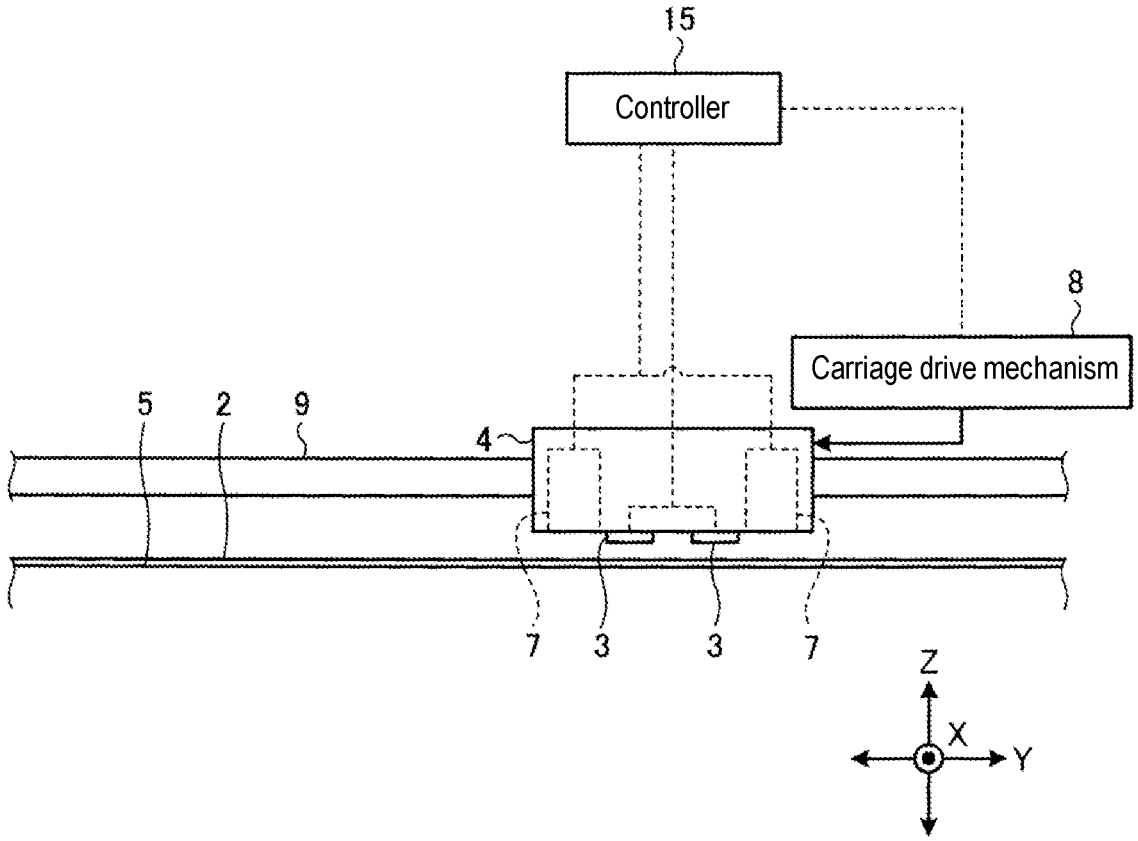
FIG. 2 is a schematic diagram of a configuration surrounding an inkjet head.
Figure 3:
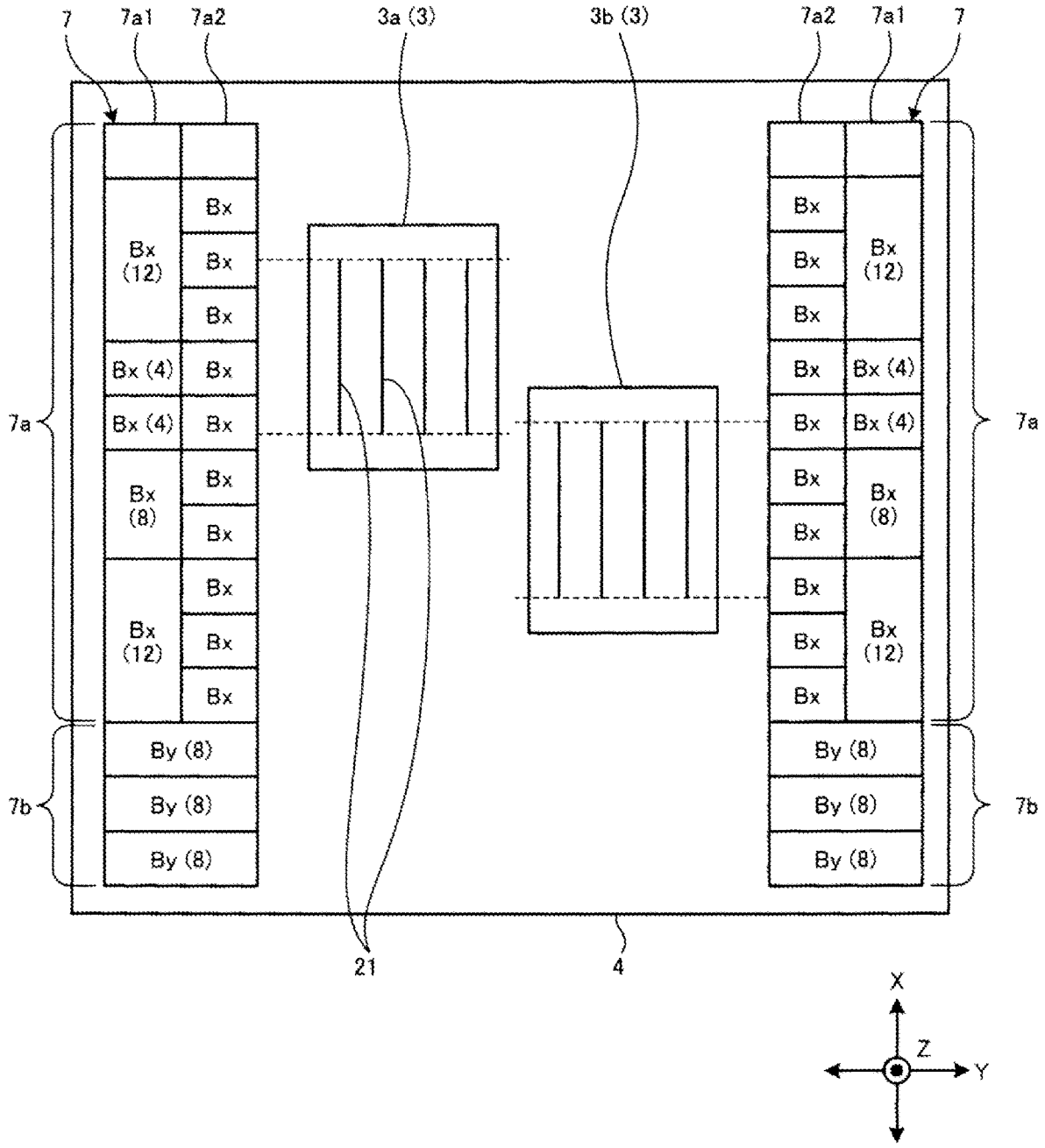
FIG. 3 is a plan view of the inkjet head on a side of a nozzle surface.

Next, the printer 1 will be described with reference to FIGS. 1 to 3. FIG. 1 is a perspective view of an inkjet printer according to this embodiment. FIG. 2 is a schematic diagram of a configuration surrounding an inkjet head. FIG. 3 is a plan view of the inkjet head on a side of a nozzle surface.

As illustrated in FIGS. 1 and 2, the printer 1 includes an inkjet head 3 (hereinafter, also simply referred to as a head 3), a carriage 4, a platen 5, an ultraviolet irradiator 7, a carriage driver 8, and a guide rail 9, an ink tank 10, and a controller 15. In FIGS. 1 and 2, an X direction corresponds to a direction where the medium 2 is conveyed; and the X direction represents a sub scanning direction. In FIG. 3, the medium 2 is conveyed from top to bottom on the drawing of FIG. 3. Here, a Y direction corresponds to a direction where the inkjet head 3 is moved; and the Y direction represents a main scanning direction. Further, a Z direction corresponds to a direction orthogonal to the main scanning direction and the sub scanning direction. For example, when a plane including each of the main scanning direction and the sub scanning direction is a horizontal plane, the Z direction corresponds to a vertical direction.

The head 3 is arranged on the carriage 4 to eject the UV ink toward the medium 2. As illustrated in FIG. 3, heads 3, the number of which is two, are arranged on the carriage 4. One of the heads 3 corresponds to a color head 3*a* for ejecting an ink using four colors of cyan, magenta, yellow, and black (CMYK); and the other of the heads 3 corresponds to a clear head 3*b* for ejecting a clear ink. The printer 1 includes the color head 3*a* and the clear head 3*b* as the heads 3 (the number of which is two). With this configuration, the printer 1 carries out a printing operation where the clear ink is overlaid on the color ink. The printing of this kind is, for example, glossy printing where the clear ink is smoothly printed. The color head 3*a* is arranged upstream of the clear head 3*b* in the direction where the medium 2 is conveyed. Each of the color head 3*a* and the clear head 3*b* includes a nozzle row 21 having a plurality of nozzles aligned in the X direction (sub scanning direction). In the color head 3*a*, the plurality of nozzle rows 21 are provided in accordance with the number of types of the colors used and, for example, the nozzle rows 21 for providing the four colors of CMYK are arranged and aligned in the Y direction. In the clear head 3*b*, the nozzle rows 21 are provided in the same number as the nozzle rows 21 of the color head 3*a*, and are arranged and aligned in the Y direction.

The platen 5 is arranged to oppose the head 3 in the Z direction. The medium 2 is mounted on the platen 5. The platen 5 heats the medium 2 mounted thereon and heats, through the medium 2, the ink ejected to the medium 2, so as to facilitate drying of the ink.

The carriage 4 has each of the heads 3 and each of the ultraviolet irradiators 7 mounted thereon. The carriage driver 8 moves the carriage 4 along the guide rail 9. The guide rail 9 extends in the Y direction. Thus, the carriage driver 8 moves the carriage 4 in the Y direction. The carriage driver 8 also moves the carriage 4 in the Z direction, so as to adjust a head gap as a gap between each of the heads 3 and the medium 2. In this state, in the carriage 4 moved by the carriage driver 8, the heads 3 and the ultraviolet irradiators 7 are integrally moved. Note that, the heads 3 and the ultraviolet irradiators 7 are integrally formed as a head unit 11, and the ink is supplied from the ink tank 10 to the head unit 11 via an ink supply line 12.

The ultraviolet irradiators 7 are arranged at both sides of the heads 3 (the number of which is two) in the Y direction. The ultraviolet irradiators 7 (the number of which is two) are arranged on the carriage 4 to irradiate the medium 2 with the ultraviolet rays, so as to cure the ink attached to the medium 2. As illustrated in FIG. 3, each of the ultraviolet irradiators 7 extends in the X direction, and includes a head-side irradiator 7*a* at one side of the X direction (upper side of FIG. 3) and a head-outer-side irradiator 7*b* at the other side of the X direction (lower side of FIG. 3).

Each of the head-side irradiators 7*a* is arranged at a position to overlap a corresponding one of the heads 3 in the X direction when viewed in the Y direction. On the other hand, each of the head-outer-side irradiators 7*b* is arranged at a position not to overlap any one of the heads 3 in the X direction when viewed in the Y direction.

Further, each of the head-side irradiators 7*a* is divided into two, and includes an inner illumination region 7*a*2 and an outer illumination region 7*a*1. The inner illumination region 7*a*2 corresponds to an illumination region near the head in the Y direction. Concurrently, the outer illumination region 7*a*1 corresponds to an illumination region opposing the head 3 across the inner illumination region 7*a*2 in the Y direction. Each of the inner illumination region 7*a*2 and the outer illumination region 7*a*1 corresponds to an illumination region that is controlled in a predetermined irradiation mode by the controller 15. The inner illumination region 7*a*2 is configured to include a plurality of irradiation blocks Bx divided in the X direction. Similarly, the outer illumination region 7*a*1 includes a plurality of irradiation blocks Bx divided in the X direction. Each of the plurality of irradiation blocks Bx is an irradiation block having a predetermined number of light emitting elements, and the predetermined number represents a minimum number of light emitting elements, each of which is controllable by the controller 15. The inner illumination region 7*a*2 has, for example, 10 of the irradiation blocks Bx aligned in the X direction, each of which has the same number (e.g., four) of light emitting elements. In other words, the irradiation blocks Bx in the inner illumination region 7*a*2 correspond to the plurality of irradiation blocks Bx aligned in the X direction, each having the same number of light emitting elements. On the other hand, the irradiation blocks Bx in the outer illumination region 7*a*1 correspond to a plurality of irradiation blocks Bx aligned in the X direction, each having a different number of light emitting elements from others. Specifically, from a side near the color head 3*a* toward a side near the clear head 3*b*, the outer illumination region 7*a*1 has the plurality of irradiation blocks Bx arranged and aligned in the X direction in a sequential order as follows: an irradiation block Bx (12) having 12 of light emitting elements, an irradiation block Bx (4) having four of light emitting elements, an irradiation block Bx (4) having four of light emitting elements, an irradiation block Bx (8) having eight of light emitting elements, and an irradiation block Bx (12) having 12 of light emitting elements.

Each of the head-outer-side irradiators 7*b* is configured to include a plurality of irradiation blocks By. Each of the plurality of irradiation blocks By is an irradiation block having a predetermined number of light emitting elements, and the predetermined number represents a minimum number of light emitting elements, each of which is controllable by the controller 15. The irradiation blocks By in the head-outer-side irradiator 7*b* correspond to irradiation blocks, each extending in the Y direction. Specifically, when viewed in the X direction, each of the irradiation blocks By extends in the Y direction over a range overlapping the outer illumination region 7*a*1 and the inner illumination region 7*a*2. The head-outer-side irradiator 7*b* has, for example, three of the irradiation blocks By aligned in the X direction, each of the irradiation blocks By having the same number (e.g., eight) of light emitting elements. In other words, the irradiation blocks By in the head-outer-side irradiator 7*b* correspond to the plurality of irradiation blocks By arranged and aligned in the X direction, each having the same number of light emitting elements.

Here, a positional relationship between the heads 3 (the number of which is two) and the ultraviolet irradiators 7 (the number of which is two) will be described. The heads 3 respectively have the nozzle rows 21 arranged at both sides in the conveyance direction of the medium 2 (X direction). In the X direction, the nozzle rows 21 at the both sides have the irradiation block Bx (4) downstream of the outer illumination region 7*a*1 interposed therebetween. Specifically, in the X direction, the color head 3*a* has the nozzle rows 21 arranged over a range from the irradiation block Bx (12) upstream of the outer illumination region 7*a*1 to the irradiation block Bx (4) downstream of the outer illumination region 7*a*1. Further, in the X direction, the color head 3*a* has the nozzle rows 21 arranged over a range corresponding to four of the irradiation blocks Bx of the inner illumination region 7*a*2. Concurrently, in the X direction, the clear head 3*b* has the nozzle rows 21 arranged over a range from the irradiation block Bx (4) downstream of the outer illumination region 7*a*1 to the irradiation block Bx (12) downstream of the outer illumination region 7*a*1. Further, in the X direction, the clear head 3*b* has the nozzle rows 21 arranged over the range corresponding to four of the irradiation blocks Bx of the inner illumination region 7*a*2.

The controller 15 is connected to the heads 3, the ultraviolet irradiators 7, and the carriage driver 8. The controller 15 includes, for example, an integrated circuit such as a central processing unit (CPU). As an example, the controller 15 controls the heads 3 such that ejection of the ink is controlled. The controller 15 controls the ultraviolet irradiators 7 such that the ultraviolet irradiation is controlled. The controller 15 controls the carriage driver 8 such that scanning speed of the heads 3 in the main scanning direction is controlled. Further, the controller 15 controls the carriage driver 8 such that the head gap between each of the heads 3 and the medium 2 is adjusted and controlled.

The controller 15 includes a gap controller 25 and a speed controller 26. The gap controller 25 adjusts the head gap in accordance with the type of medium 2 installed on the platen 5. For example, when the medium 2 has large surface roughness on the surface to be printed, the gap controller 25 increases the head gap; on the other hand, when the medium 2 has smooth surface roughness on the surface to be printed, the gap controller 25 decreases the head gap. The gap controller 25 adjusts, for example, size of the head gap in a stepwise manner. Specifically, the gap controller 25 adjusts the head gap at three stages of a "small head gap", a "medium head gap", and a "large head gap" in accordance with the type of medium 2. Note that, the gap controller 25 may continuously adjust the size of the head gap. The speed controller 26 controls the scanning speed of each of the heads 3 in the main scanning direction.

Further, the controller 15 has a first irradiation mode and a second irradiation mode, and selectively switches between the first irradiation mode and the second irradiation mode based on a threshold value. In the first irradiation mode, the controller 15 controls each of the irradiation blocks Bx such that the inner illumination region 7*a*2 is turned off (unlit) and the outer illumination region 7*a*1 is turned on (lit). In the second irradiation mode, the inner illumination region 7*a*2 is turned on (lit) and concurrently, the outer illumination region 7*a*1 is turned on (lit). The threshold value corresponds to a value of whether or not the head 3 is clogged with the ink due to stray light. When the controller 15 determines based on the threshold value that the head 3 is to be clogged with the ink, the controller 15 executes the first irradiation mode. On the other hand, when the controller 15 determines based on the threshold value that the head 3 is not to be clogged with the ink, the controller 15 executes the second irradiation mode.

Specifically, the controller 15 selectively switches between the first irradiation mode and the second irradiation mode in accordance with at least any one of the head gap, the reflectance of the surface to be printed in the medium 2, and the scanning speed of the head 3. With regard to the head gap, the controller 15 executes the first irradiation mode when the head gap adjusted by the gap controller 25 is equal to or greater than the threshold value. On the other hand, the controller 15 executes the second irradiation mode when the head gap is smaller than the threshold value. With regard to the reflectance of the surface to be printed in the medium 2, the controller 15 executes the first irradiation mode when the reflectance of the medium 2 selected is equal to or greater than the threshold value. On the other hand, the controller 15 executes the second irradiation mode when the reflectance is smaller than the threshold value. With regard to the scanning speed of the head 3, the controller 15 executes the first irradiation mode when the scanning speed of the head 3 controlled by the speed controller 26 is equal to or smaller than the threshold value. On the other hand, the controller 15 executes the second irradiation mode when the scanning speed of the head 3 is greater than the threshold value.

The controller 15 also controls each of the irradiation blocks Bx of the outer illumination region 7*a*1 in accordance with a print condition. For example, in a case of the glossy printing, among the irradiation blocks Bx of the outer illumination region 7*a*1 that are disposed at the same position as the nozzle rows 21 of the color head 3*a* in the X direction, the controller 15 turns off the irradiation block Bx (4) and the irradiation block Bx (4), each of which is positioned near the clear head 3*b*. Further, in the case of glossy printing, the controller 15 turns off the irradiation block Bx (8) and the irradiation block Bx (12) of the outer illumination region 7*a*1, each of which is disposed at the same position as the nozzle rows 21 of the clear head 3*b* in the X direction. Note that in the case of glossy printing, the controller 15 also turns off the inner illumination region 7*a*2. The controller 15 turns off the irradiation blocks Bx as has been described above, so that the clear ink, which has been ejected from the clear head 3*b* and attached to the medium 2, is less prone to be subjected to the ultraviolet irradiation from the irradiation blocks Bx near the color head 3*a*. With this configuration, the controller 15 controls the curing of the clear ink, and facilitates the smoothness of the clear ink due to spread of the clear ink.

As has been described above, with the inkjet printer 1 according to the first embodiment, when the stray light is generated in the head 3, the first irradiation mode is selected, so that the inner illumination region 7*a*2 of the ultraviolet irradiator 7 is turned off (unlit). In other words, the illumination region near the head 3 is unlit such that the head 3 is less prone to be subjected to the ultraviolet irradiation. With this configuration, the stray light directed to the head 3 is reduced, and the head 3 is less prone to be clogged with the ink due to the stray light. On the other hand, when the head 3 is not clogged with the ink due to the stray light, the second irradiation mode is selected such that the ink is cured quickly.

With the inkjet printer 1 according to the first embodiment, when the head gap is equal to or greater than the threshold value, the stray light increases in the amount corresponding to the difference between the head gap and the threshold value. Accordingly, the first irradiation mode is selected such that the stray light directed to the head 3 is reduced. On the other hand, when the head gap is smaller than the threshold value, the stray light is less prone to be generated. Accordingly, the second irradiation mode is selected such that the ink is cured quickly.

Further, with the inkjet printer 1 according to the first embodiment, when the reflectance of the medium 2 is equal to or greater than the threshold value, the stray light increases in the amount corresponding to the difference between the reflectance and the threshold value. Accordingly, the first irradiation mode is selected such that the stray light directed to the inkjet head is reduced. On the other hand, when the reflectance of the medium 2 is smaller than the threshold value, the stray light is less prone to be generated. Accordingly, the second irradiation mode is selected such that the ink is cured quickly.

Still further, with the inkjet printer 1 according to the first embodiment, when the scanning speed of the head 3 is equal to or smaller (i.e., slower) than the threshold value, the stray light increases in the amount corresponding to the increase in cumulative light quantity, the cumulative light directed to the ink. Accordingly, the first irradiation mode is selected such that the stray light directed to the head 3 is reduced. On the other hand, when the scanning speed of the head 3 is greater than the threshold value, the stray light is less prone to be generated. Accordingly, the second irradiation mode is selected such that the ink is cured quickly.

Note that, in the description of the first embodiment, the UV ink is applied, but the ink is not particularly restricted to the UV ink.

Further, in this embodiment, the head-side irradiator 7*a* is divided in the Y direction into two, but may be divided into three. In other words, as long as the head-side irradiator 7*a* includes the inner illumination region 7*a*2 and the outer illumination region 7*a*1, the head-side irradiator 7*a* may be divided into any number.

Second Embodiment

Next, an inkjet printer 1 according to a second embodiment will be described. Note that, in the second embodiment, parts different from those of the first embodiment will be described, and shared parts are denoted with the same reference signs as in the first embodiment.

In the printer 1 of the second embodiment, the controller 15 executes a third irradiation mode and a fourth irradiation mode instead of the first irradiation mode and the second irradiation mode in the first embodiment. Specifically, the controller 15 has the third irradiation mode and the fourth irradiation mode, and selectively switches between the third irradiation mode and the fourth irradiation mode based on a threshold value. In the third irradiation mode, each of the inner illumination region 7*a*2 and the outer illumination region 7*a*1 is turned on (lit), and the inner illumination region 7*a*2 has a radiation intensity smaller than that of the outer illumination region 7*a*1. In the third irradiation mode, the controller 15 has the inner illumination region 7*a*2 lit at the radiation intensity equal to or smaller than 50 μW. In the fourth irradiation mode, each of the inner illumination region 7*a*2 and the outer illumination region 7*a*1 is lit at a same radiation intensity. As in the first embodiment, the threshold value corresponds to a value of whether or not the head 3 is clogged with ink due to stray light. When the controller 15 determines based on the threshold value that the head 3 is to be clogged with the ink, the controller 15 executes the third irradiation mode. On the other hand, when the controller 15 determines based on the threshold value that the head 3 is not to be clogged with the ink, the controller 15 executes the fourth irradiation mode.

Specifically, as in the first embodiment, the controller 15 selectively switches between the third irradiation mode and the fourth irradiation mode in accordance with at least any one of a head gap, reflectance of a surface to be printed in the medium 2, and scanning speed of the head 3. With regard to the head gap, the controller 15 executes the third irradiation mode when the head gap adjusted by the gap controller 25 is equal to or greater than the threshold value. On the other hand, the controller 15 executes the fourth irradiation mode when the head gap is smaller than the threshold value. With regard to the reflectance of the surface to be printed in the medium 2, the controller 15 executes the third irradiation mode when the reflectance of the medium 2 selected is equal to or greater than the threshold value. On the other hand, the controller 15 executes the fourth irradiation mode when the reflectance is smaller than the threshold value. With regard to the scanning speed of the head 3, the controller 15 executes the third irradiation mode when the scanning speed of the head 3 controlled by the speed controller 26 is equal to or smaller than the threshold value. On the other hand, the controller 15 executes the fourth irradiation mode when the scanning speed of the head 3 is greater than the threshold value.

As has been described above, with the inkjet printer 1 according to the second embodiment, when the stray light is generated in the head 3, the third irradiation mode is selected, so that the inner illumination region 7*a*2 of the ultraviolet irradiator 7 has the radiation intensity reduced. In other words, an illumination region near the head 3 has the radiation intensity reduced, so that the head 3 is less prone to be subjected to the ultraviolet irradiation. With this configuration, the stray light directed to the head 3 is reduced, and the head 3 is less prone to be clogged with the ink due to the stray light. On the other hand, when the head 3 is not clogged with the ink due to the stray light, the fourth irradiation mode is selected such that the ink is cured quickly.

With the inkjet printer 1 according to the second embodiment, when the head gap is equal to or greater than the threshold value, the stray light increases in the amount corresponding to the difference between the head gap and the threshold value. Accordingly, the third irradiation mode is selected such that the stray light directed to the head 3 is reduced. On the other hand, when the head gap is smaller than the threshold value, the stray light is less prone to be generated. Accordingly, the fourth irradiation mode is selected such that the ink is cured quickly.

Further, with the inkjet printer 1 according to the second embodiment, when the reflectance of the medium 2 is equal to or greater than the threshold value, the stray light increases in the amount corresponding to the difference between the reflectance and the threshold value. Accordingly, the third irradiation mode is selected such that the stray light directed to the inkjet head is reduced. On the other hand, when the reflectance of the medium 2 is smaller than the threshold value, the stray light is less prone to be generated. Accordingly, the fourth irradiation mode is selected such that the ink is cured quickly.

Still further, with the inkjet printer 1 according to the second embodiment, when the scanning speed of the head 3 is equal to or smaller (i.e., slower) than the threshold value, the stray light increases in the amount corresponding to the increase in cumulative light quantity, the cumulative light directed to the ink. Accordingly, the third irradiation mode is selected such that the stray light directed to the head 3 is reduced. On the other hand, when the scanning speed of the head 3 is greater than the threshold value, the stray light is less prone to be generated. Accordingly, the fourth irradiation mode is selected such that the ink is cured quickly.

Note that, the first embodiment and the second embodiment may be combined. In other words, the controller 15 may execute any one of the first irradiation mode, the second irradiation mode, the third irradiation mode, and the fourth irradiation mode. In this case, the second irradiation mode and the fourth irradiation mode are substantially the same and thus may be combined.

Third Embodiment

Figure 4:
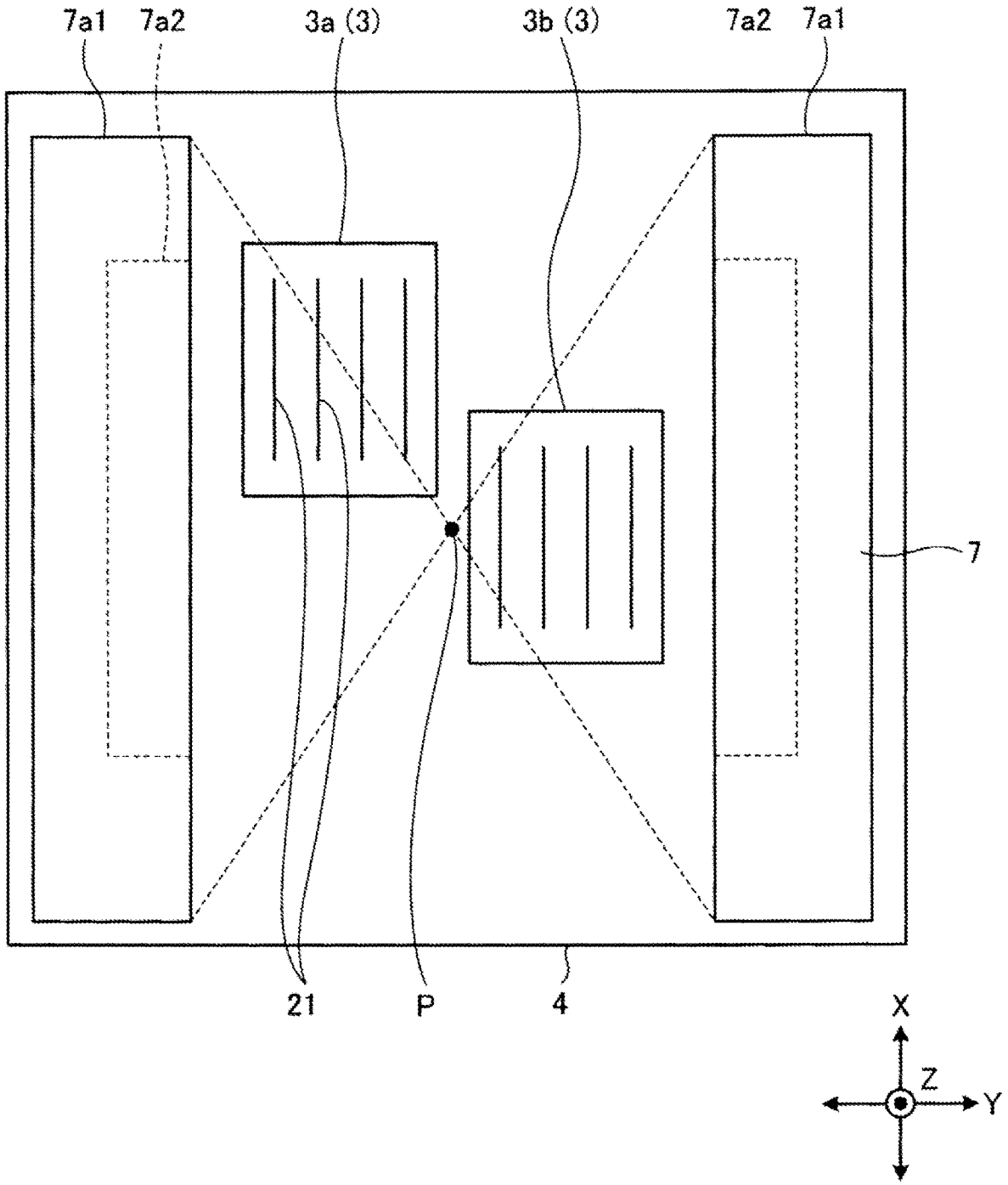
FIG. 4 is a plan view of an inkjet head on a side of a nozzle surface, each of the inkjet head and the nozzle surface according to a third embodiment.

Next, an inkjet printer 1 according to a third embodiment will be described with reference to FIG. 4. FIG. 4 is a plan view of an inkjet head on a side of a nozzle surface, each of the inkjet head and the nozzle surface according to the third embodiment. Note that, in the third embodiment, parts different from those of the first embodiment and the second embodiment will be described, and shared parts are denoted with the same reference signs as in the first and second embodiments.

In the printer 1 of the third embodiment, the ultraviolet irradiators 7, the number of which is two, are arranged on the carriage 4 and have an identical structure to each other. As illustrated in FIG. 4, the ultraviolet irradiators 7 have the identical structure and, within a plane including the X direction and the Y direction, are arranged point-symmetrically to each other at a symmetric point P as a center, having phases of the ultraviolet irradiators 7 different from each other by an amount equal to 180 degrees. In other words, within an X-Y plane including the X direction and the Y direction, one of the ultraviolet irradiators 7 is positioned to be rotated about the symmetric point P by the amount equal to 180 degrees with respect to the other of the ultraviolet irradiators 7. With this configuration, the inner illumination region 7*a*2 and the outer illumination region 7*a*1 in one of the ultraviolet irradiators 7 (the number of which is two) are arranged point-symmetrically at the symmetric point P as the center with respect to the inner illumination region 7*a*2 and the outer illumination region 7*a*1 in the other of the ultraviolet irradiators 7, having the phases different by the amount equal to 180 degrees from those of the inner illumination region 7*a*2 and the outer illumination region 7*a*1 in the other of the ultraviolet irradiators 7.

Here, within the X-Y plane, each of the outer illumination regions 7*a*1 has an irradiated region at its both ends in the X direction extending toward the head 3 in the Y direction, and thus is formed in a recessed shape. Each of the inner illumination regions 7*a*2 is arranged inside a corresponding one of the outer illumination regions 7*a*1 of the recessed shape, having its both ends in the X direction in contact with the corresponding one of the outer illumination regions 7*a*1.

As has been described above, with the inkjet printer 1 according to the third embodiment, the ultraviolet irradiators 7 (the number of which is two) are arranged point-symmetrically to each other, so that the ultraviolet irradiators 7 have the identical structure. With this configuration, an increase in cost of apparatus is reduced.

Note that, as in the first embodiment, each of the outer illumination region 7*a*1 and the inner illumination region 7*a*2 may extend in the X direction. As long as the ultraviolet irradiators 7 (the number of which is two) have a left-to-right symmetric structure when arranged point-symmetrically to each other, the outer illumination region 7*a*1 and the inner illumination region 7*a*2 may extend in any one of the Y direction and the X direction.

Further, in the first, second, and third embodiments, the head-side irradiator 7*a* in each of the ultraviolet irradiators 7 includes the inner illumination region 7*a*2 and the outer illumination region 7*a*1. However, as long as the ink is sufficiently cured by the ultraviolet irradiation from the outer illumination region 7*a*1, the inner illumination region 7*a*2 may be excluded in each of the ultraviolet irradiators 7.

What is claimed is:

1. An inkjet printer comprising:

an inkjet head configured to eject an ink of an ultraviolet-curable type to a recording medium;

an ultraviolet irradiator arranged to adjoin the inkjet head in a main scanning direction where the inkjet head relatively moves with respect to the recording medium, the ultraviolet irradiator configured to irradiate the ink with an ultraviolet ray; and a controller configured to control the ultraviolet irradiator, wherein the ultraviolet irradiator includes:

an inner illumination region, arranged near the inkjet head in the main scanning direction; and an outer illumination region, arranged opposite the inkjet head across the inner illumination region in the main scanning direction, wherein the controller includes:

a first irradiation mode, where an irradiation block provided in the inner illumination region is unlit and the irradiation block provided in the outer illumination region is lit; and a second irradiation mode, where the irradiation block provided in the inner illumination region is lit and the irradiation block provided in the outer illumination region is lit.

2. The inkjet printer according to claim 1, wherein the controller includes a gap controller configured to adjust a head gap as a gap between the recording medium and the inkjet head, the controller executes the first irradiation mode when the head gap is equal to or greater than a threshold value, and the controller executes the second irradiation mode when the head gap is smaller than the threshold value.

3. The inkjet printer according to claim 2, wherein the ultraviolet irradiators, the number of which is two, are arranged at both sides in the main scanning direction across the inkjet head, the ultraviolet irradiators have an identical structure to each other, and within a plane including the main scanning direction and a sub scanning direction orthogonal to the main sub scanning direction, the ultraviolet irradiators are arranged point-symmetrically to each other at a symmetric point as a center, having phases of the ultraviolet irradiators different from each other by an amount equal to 180 degrees.

4. The inkjet printer according to claim 1, wherein the recording medium is prepared in a plurality of types, each having different reflectance from the others, the controller executes the first irradiation mode when the reflectance of the recording medium is equal to or greater than a threshold value, and the controller executes the second irradiation mode when the reflectance of the recording medium is smaller than the threshold value.

5. The inkjet printer according to claim 4, wherein the ultraviolet irradiators, the number of which is two, are arranged at both sides in the main scanning direction across the inkjet head, the ultraviolet irradiators have an identical structure to each other, and within a plane including the main scanning direction and a sub scanning direction orthogonal to the main sub scanning direction, the ultraviolet irradiators are arranged point-symmetrically to each other at a symmetric point as a center, having phases of the ultraviolet irradiators different from each other by an amount equal to 180 degrees.

6. The inkjet printer according to claim 1, wherein the controller includes a speed controller configured to adjust scanning speed of the inkjet head, the controller executes the first irradiation mode when the scanning speed of the inkjet head is equal to or smaller than a threshold value, and the controller executes the second irradiation mode when the scanning speed of the inkjet head is greater than the threshold value.

7. The inkjet printer according to claim 6, wherein the ultraviolet irradiators, the number of which is two, are arranged at both sides in the main scanning direction across the inkjet head, the ultraviolet irradiators have an identical structure to each other, and within a plane including the main scanning direction and a sub scanning direction orthogonal to the main sub scanning direction, the ultraviolet irradiators are arranged point-symmetrically to each other at a symmetric point as a center, having phases of the ultraviolet irradiators different from each other by an amount equal to 180 degrees.

8. The inkjet printer according to claim 1, wherein the ultraviolet irradiators, the number of which is two, are arranged at both sides in the main scanning direction across the inkjet head, the ultraviolet irradiators have an identical structure to each other, and within a plane including the main scanning direction and a sub scanning direction orthogonal to the main sub scanning direction, the ultraviolet irradiators are arranged point-symmetrically to each other at a symmetric point as a center, having phases of the ultraviolet irradiators different from each other by an amount equal to 180 degrees.

9. An inkjet printer comprising:

an inkjet head configured to eject an ink of an ultraviolet-curable type to a recording medium;

an ultraviolet irradiator arranged to adjoin the inkjet head in a main scanning direction where the inkjet head relatively moves with respect to the recording medium, the ultraviolet irradiator configured to irradiate the ink with an ultraviolet ray; and a controller configured to control the ultraviolet irradiator, wherein the ultraviolet irradiator includes:

an inner illumination region, arranged near the inkjet head in the main scanning direction; and an outer illumination region, arranged opposite the inkjet head across the inner illumination region in the main scanning direction, wherein the controller includes:

a first irradiation mode, where an irradiation block provided in the inner illumination region is lit, having a radiation intensity smaller than a radiation intensity of the irradiation block provided in the outer illumination region that is lit; and a second irradiation mode, where the irradiation block provided in the inner illumination region is lit, having the radiation intensity equal to the radiation intensity of the irradiation block provided in the outer illumination region that is lit.

10. The inkjet printer according to claim 9, wherein the controller includes a gap controller configured to adjust a head gap as a gap between the recording medium and the inkjet head, the controller executes the first irradiation mode when the head gap is equal to or greater than a threshold value, and the controller executes the second irradiation mode when the head gap is smaller than the threshold value.

11. The inkjet printer according to claim 10, wherein the ultraviolet irradiators, the number of which is two, are arranged at both sides in the main scanning direction across the inkjet head, the ultraviolet irradiators have an identical structure to each other, and within a plane including the main scanning direction and a sub scanning direction orthogonal to the main sub scanning direction, the ultraviolet irradiators are arranged point-symmetrically to each other at a symmetric point as a center, having phases of the ultraviolet irradiators different from each other by an amount equal to 180 degrees.

12. The inkjet printer according to claim 9, wherein the recording medium is prepared in a plurality of types, each having different reflectance from the others, the controller executes the first irradiation mode when the reflectance of the recording medium is equal to or greater than a threshold value, and the controller executes the second irradiation mode when the reflectance of the recording medium is smaller than the threshold value.

13. The inkjet printer according to claim 12, wherein the ultraviolet irradiators, the number of which is two, are arranged at both sides in the main scanning direction across the inkjet head, the ultraviolet irradiators have an identical structure to each other, and within a plane including the main scanning direction and a sub scanning direction orthogonal to the main sub scanning direction, the ultraviolet irradiators are arranged point-symmetrically to each other at a symmetric point as a center, having phases of the ultraviolet irradiators different from each other by an amount equal to 180 degrees.

14. The inkjet printer according to claim 9, wherein the controller includes a speed controller configured to adjust scanning speed of the inkjet head, the controller executes the first irradiation mode when the scanning speed of the inkjet head is equal to or smaller than a threshold value, and the controller executes the second irradiation mode when the scanning speed of the inkjet head is greater than the threshold value.

15. The inkjet printer according to claim 14, wherein the ultraviolet irradiators, the number of which is two, are arranged at both sides in the main scanning direction across the inkjet head, the ultraviolet irradiators have an identical structure to each other, and within a plane including the main scanning direction and a sub scanning direction orthogonal to the main sub scanning direction, the ultraviolet irradiators are arranged point-symmetrically to each other at a symmetric point as a center, having phases of the ultraviolet irradiators different from each other by an amount equal to 180 degrees.

16. The inkjet printer according to claim 9, wherein the ultraviolet irradiators, the number of which is two, are arranged at both sides in the main scanning direction across the inkjet head, the ultraviolet irradiators have an identical structure to each other, and within a plane including the main scanning direction and a sub scanning direction orthogonal to the main sub scanning direction, the ultraviolet irradiators are arranged point-symmetrically to each other at a symmetric point as a center, having phases of the ultraviolet irradiators different from each other by an amount equal to 180 degrees.

* * * * *